US007200553B2

(12) United States Patent
Patel et al.

(10) Patent No.: US 7,200,553 B2
(45) Date of Patent: Apr. 3, 2007

(54) LPAS SPEECH CODER USING VECTOR QUANTIZED, MULTI-CODEBOOK, MULTI-TAP PITCH PREDICTOR AND OPTIMIZED TERNARY SOURCE EXCITATION CODEBOOK DERIVATION

(75) Inventors: Jayesh S. Patel, Lowell, MA (US); Douglas E. Kolb, Bedford, MA (US)

(73) Assignee: Tellabs Operations, Inc., Naperville, IL (US)

( * ) Notice: Subject to any disclaimer, the term of this patent is extended or adjusted under 35 U.S.C. 154(b) by 0 days.

(21) Appl. No.: 11/041,478

(22) Filed: Jan. 24, 2005

(65) Prior Publication Data

US 2005/0143986 A1 Jun. 30, 2005

Related U.S. Application Data

(60) Division of application No. 09/991,763, filed on Nov. 21, 2001, now Pat. No. 6,865,530, which is a continuation of application No. 09/455,063, filed on Dec. 6, 1999, now Pat. No. 6,393,390, which is a continuation of application No. 09/130,688, filed on Aug. 6, 1998, now Pat. No. 6,014,618.

(51) Int. Cl.
*G10L 19/08* (2006.01)

(52) U.S. Cl. ..... 704/223

(58) Field of Classification Search ..... None
See application file for complete search history.

(56) References Cited

U.S. PATENT DOCUMENTS 5,371,853 A 12/1994 Kao et al.
5,491,771 A 2/1996 Gupta et al.
5,717,823 A 2/1998 Kleijn
5,781,880 A 7/1998 Su
6,014,618 A 1/2000 Patel et al.
6,144,655 A 11/2000 Kim
6,161,086 A 12/2000 Mukherjee et al.
6,393,390 B1 5/2002 Patel et al.
6,865,530 B2 * 3/2005 Patel et al. ..... 704/223

OTHER PUBLICATIONS

Schroeder, M.R. and Atal, B.S., "Code-Excited Linear Prediction (CELP): High-Quality Speech at Very Low Bit Rates", IEEE Proceedings of the International Conference on Acoustics, Speech and Signal Processing, 937-940 (1985).

(Continued)

*Primary Examiner*—Susan McFadden
(74) *Attorney, Agent, or Firm*—Hamilton, Brook, Smith & Reynolds, P.C.

(57) ABSTRACT

A method and apparatus for reducing the complexity of linear prediction analysis-by-synthesis (LPAS) speech coders. The speech coder includes a multi-tap pitch predictor having various parameters and utilizing an adaptive codebook subdivided into at least a first vector codebook and a second vector codebook. The pitch predictor removes certain redundancies in a subject speech signal and vector quantizes the pitch predictor parameters. Further included is a source excitation (fixed) codebook that indicates pulses in the subject speech signal by deriving corresponding vector values. Serial optimization of the adaptive codebook first and then the fixed codebook produces a low complexity LPAS speech coder of the present invention.

22 Claims, 7 Drawing Sheets

OTHER PUBLICATIONS

Kroon, P. and Atal, B.S., "On Improving the Performance of Pitch Predictors in Speech Coding Systems", *Advances in Speech Coding*, Kluwner Academic Publisher, Boston, Massachusetts, pp. 321-327 (1991).

Veeneman, D. and Mazor, B., "Efficient Multi-Tap Pitch Prediction for Stochastic Coding", Speech and Audio Coding for Wireless and Network Applications, Kluwner Academic Publisher, Boston, Massachusetts, pp. 225-229 (1993).

Chen, Juin-Hwey, "Toll-Quality 16 KB/S CELP Speech Coding with Very Low Complexity", *IEEE Proceedings of the International Conference on Acoustics, Speech and Signal Processing*: pp. 9-12 (1995).

"ICSPAT Speech Analysis & Synthesis", schedule of lectures, http://www.dspworld.com/ics98c/26.htm (Jul. 28, 1998).

"Enhanced Low Memory CELP Vocoder—C5x/C2xx", DSP Software Solutions (catalog) (Sep. 1997).

* cited by examiner

MULTI-TAP PITCH PREDICTOR VQ

MULTI-TAP PITCH PREDICTOR PRODUCT VQ

LPAS SPEECH CODER USING VECTOR QUANTIZED, MULTI-CODEBOOK, MULTI-TAP PITCH PREDICTOR AND OPTIMIZED TERNARY SOURCE EXCITATION CODEBOOK DERIVATION

RELATED APPLICATIONS

This application is a Divisional of U.S. application Ser. No. 09/991,763, filed on Nov. 21, 2001 now U.S. Pat. No. 6,865,530, which is a Continuation of U.S. application Ser. No. 09/455,063, filed on Dec. 6, 1999, now U.S. Pat. No. 6,393,390, which is a Continuation of U.S. application Ser. No. 09/130,688, filed Aug. 6, 1998, now U.S. Pat. No. 6,014,618, the entire contents of which are incorporated herein by reference.

FIELD OF INVENTION

The present invention relates to the improved method and system for digital encoding of speech signals, more particularly to Linear Predictive Analysis-by-Synthesis (LPAS) based speech coding.

BACKGROUND OF THE INVENTION

LPAS coders have given new dimension to medium-bit rate (8–16 Kbps) and low-bit rate (2–8 Kbps) speech coding research. Various forms of LPAS coders are being used in applications like secure telephones, cellular phones, answering machines, voice mail, digital memo recorders, etc. The reason is that LPAS coders exhibit good speech quality at low bit rates. LPAS coders are based on a speech production model 39 (illustrated in FIG. 1) and fall into a category between waveform coders and parametric coders (Vocoder); hence they are referred to as hybrid coders.

Referring to FIG. 1, the speech production model 39 parallels basic human speech activity and starts with the excitation source 41 (i.e., the breathing of air in the lungs). Next the working amount of air is vibrated through a vocal chord 43. Lastly, the resulting pulsed vibrations travel through the vocal tract 45 (from vocal chords to voice box) and produce audible sound waves, i.e., speech 47.

Correspondingly, there are three major components in LPAS coders. These are (i) a short-term synthesis filter 49, (ii) a long-term synthesis filter 51, and (iii) an excitation codebook 53. The short-term synthesis filter includes a short-term predictor in its feed-back loop. The short-term synthesis filter 49 models the short-term spectrum of a subject speech signal at the vocal tract stage 45. The short-term predictor of 49 is used for removing the near-sample redundancies (due to the resonance produced by the vocal tract 45) from the speech signal. The long-term synthesis filter 51 employs an adaptive codebook 55 or pitch predictor in its feedback loop. The pitch predictor 55 is used for removing far-sample redundancies (due to pitch periodicity produced by a vibrating vocal chord 43) in the speech signal. The source excitation 41 is modeled by a so-called "fixed codebook" (the excitation code book) 53.

In turn, the parameter set of a conventional LPAS based coder consists of short-term parameters (short-term predictor), long-term parameters and fixed codebook 53 parameters. Typically short-term parameters are estimated using standard 10–12th order LPC (Linear predictive coding) analysis.

The foregoing parameter sets are encoded into a bitstream for transmission or storage. Usually, short-term parameters are updated on a frame-by-frame basis (every 20–30 msec or 160–240 samples) and long-term and fixed codebook parameters are updated on a subframe basis (every 5–7.5 msec or 40–60 samples). Ultimately, a decoder (not shown) receives the encoded parameter sets, appropriately decodes them and digitally reproduces the subject speech signal (audible speech) 47.

Most of the state-of-the art LPAS coders differ in fixed codebook 53 implementation and pitch predictor or adaptive codebook implementation 55. Examples of LPAS coders are Code Excited Linear Predictive (CELP) coder, Multi-Pulse Excited Linear Predictive (MPLPC) coder, Regular Pulse Linear Predictive (RPLPC) coder, Algebraic CELP (ACELP) coder, etc. Further, the parameters of the pitch predictor or adaptive codebook 55 and fixed codebook 53 are typically optimized in a closed-loop using an analysis-by-synthesis method with perceptually-weighted minimum (mean squared) error criterion. See Manfred R. Schroeder and B. S. Atal, "Code-Excited Linear Prediction (CELP): High Quality Speech at Very Low Bit Rates," *IEEE Proceedings of the International Conference on Acoustics, Speech and Signal Processing*, Tampa, Fla., pp. 937–940, 1985.

The major attributes of speech-coders are:

1. Speech Quality
2. Bit-rate
3. Time and Space complexity
4. Delay

Due to the closed-loop parameter optimization of the pitch-predictor 55 and fixed codebook 53, the complexity of the LPAS coder is enormously high as compared to a waveform coder. The LPAS coder produces considerably good speech quality around 8–16 kbps. Further improvement in the speech quality of LPAS based coders can be obtained by using sophisticated algorithms, one of which is the multi-tap pitch predictor (MTPP). Increasing the number of taps in the pitch predictor increases the prediction gain, hence improving the coding efficiency. On the other hand, estimating and quantizing MTPP parameters increases the computational complexity and memory requirements of the coder.

Another very computationally expensive algorithm in an LPAS based coder is the fixed codebook search. This is due to the analysis-by-synthesis based parameter optimization procedure.

Today, speech coders are often implemented on Digital Signal Processors (DSP). The cost of a DSP is governed by the utilization of processor resources (MIPS/RAM/ROM) required by the speech coder.

SUMMARY OF THE INVENTION

One object of the present invention is to provide a method for reducing the computational complexity and memory requirements (MIPS/RAM/ROM) of an LPAS coder while maintaining the speech quality. This reduction in complexity allows a high quality LPAS coder to run in real-time on an inexpensive general purpose fixed point DSP or other similar digital processor.

Accordingly, the present invention method provides (i) an LPAS speech encoder reduced in computational complexity and memory requirements, and (ii) a method for reducing the computational complexity and memory requirements of an LPAS speech encoder, and in particular a multi-tap pitch predictor and the source excitation codebook in such an encoder. The invention employs fast structured product code vector quantization (PCVQ) for quantizing the parameters of the multi-tap pitch predictor within the analysis-by-synthesis search loop. The present invention also provides a fast procedure for searching the best code-vector in the fixed-code book. To achieve this, the fixed codebook is preferably formed of ternary values (1,−1,0).

In a preferred embodiment, the multi-tap pitch predictor has a first vector codebook and a second (or more) vector codebook. The invention method sequentially searches the first and second vector codebooks.

Further, the invention includes forming the source excitation codebook by using non-contiguous positions for each pulse.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 2A:
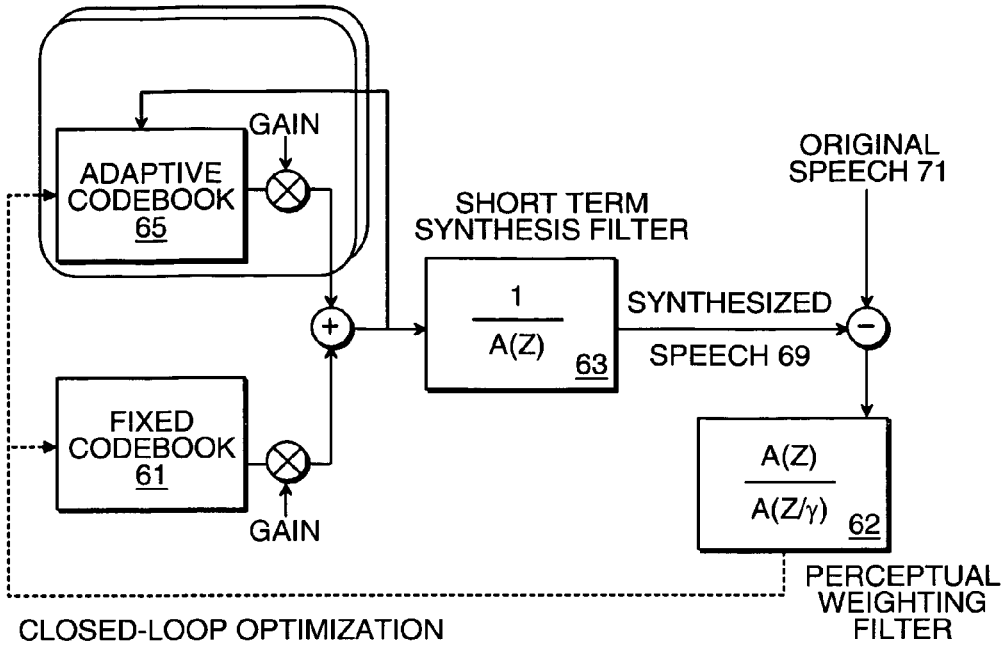
FIGS. 2*a* and 2*b* are block diagrams of an LPAS speech coder with closed loop optimization.

Generally illustrated in FIG. 2*a* is an LPAS coder with closed loop optimization. Typically, the fixed codebook 61 holds over 1024 parameter values, while the adaptive codebook 65 holds just over 128 or so values. Different combinations of those values are adjusted by a term $$\frac{1}{A(z)}$$

(i.e., the short term synthesis filter 63) to produce synthesized signal 69. The resulting synthesized signal 69 is compared to (i.e., subtracted from) the original speech signal 71 to produce an error signal. This error term is adjusted through perceptual weighting filter 62, i.e., $$\frac{A(z)}{A(z/\gamma)},$$

and fed back into the decision making process for choosing values from the fixed codebook 61 and the adaptive codebook 65.

Figure 2B:
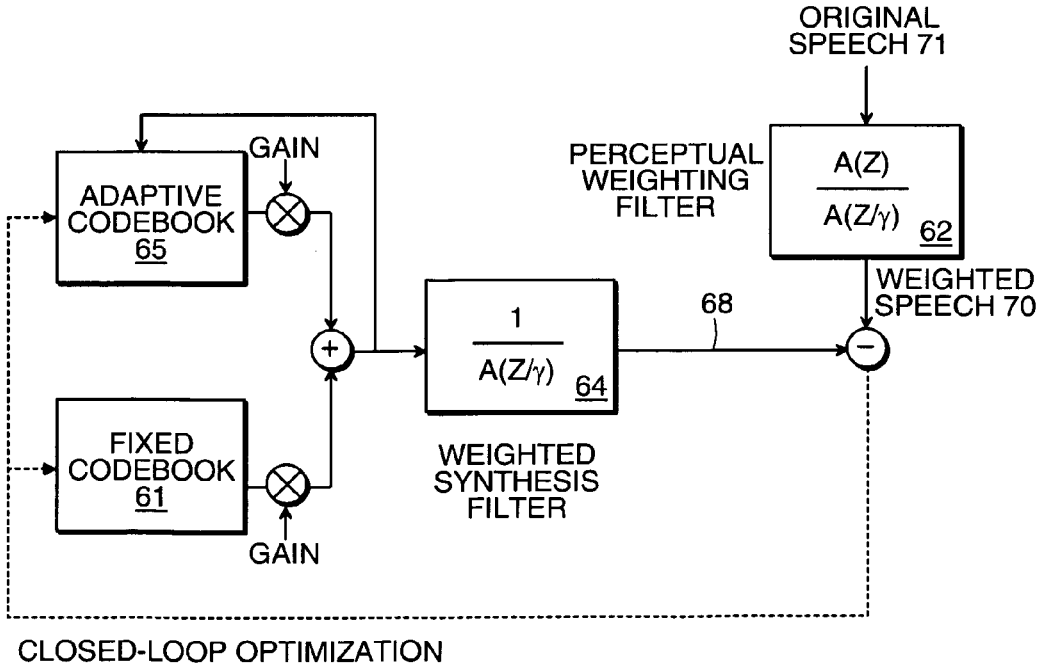

Another way to state the closed loop error adjustment of FIG. 2*a* is shown in FIG. 2*b*. Different combinations of adaptive codebook 65 and fixed codebook 61 are adjusted by weighted synthesis filter 64 to produce weighted synthesis speech signal 68. The original speech signal is adjusted by perceptual weighted filter 62 to produce weighted speech signal 70. The weighted synthesis signal 68 is compared to weighted speech signal 70 to produce an error signal. This error signal is fed back into the decision making process for choosing values from the fixed codebook 61 and adaptive codebook 65.

Figure 3:
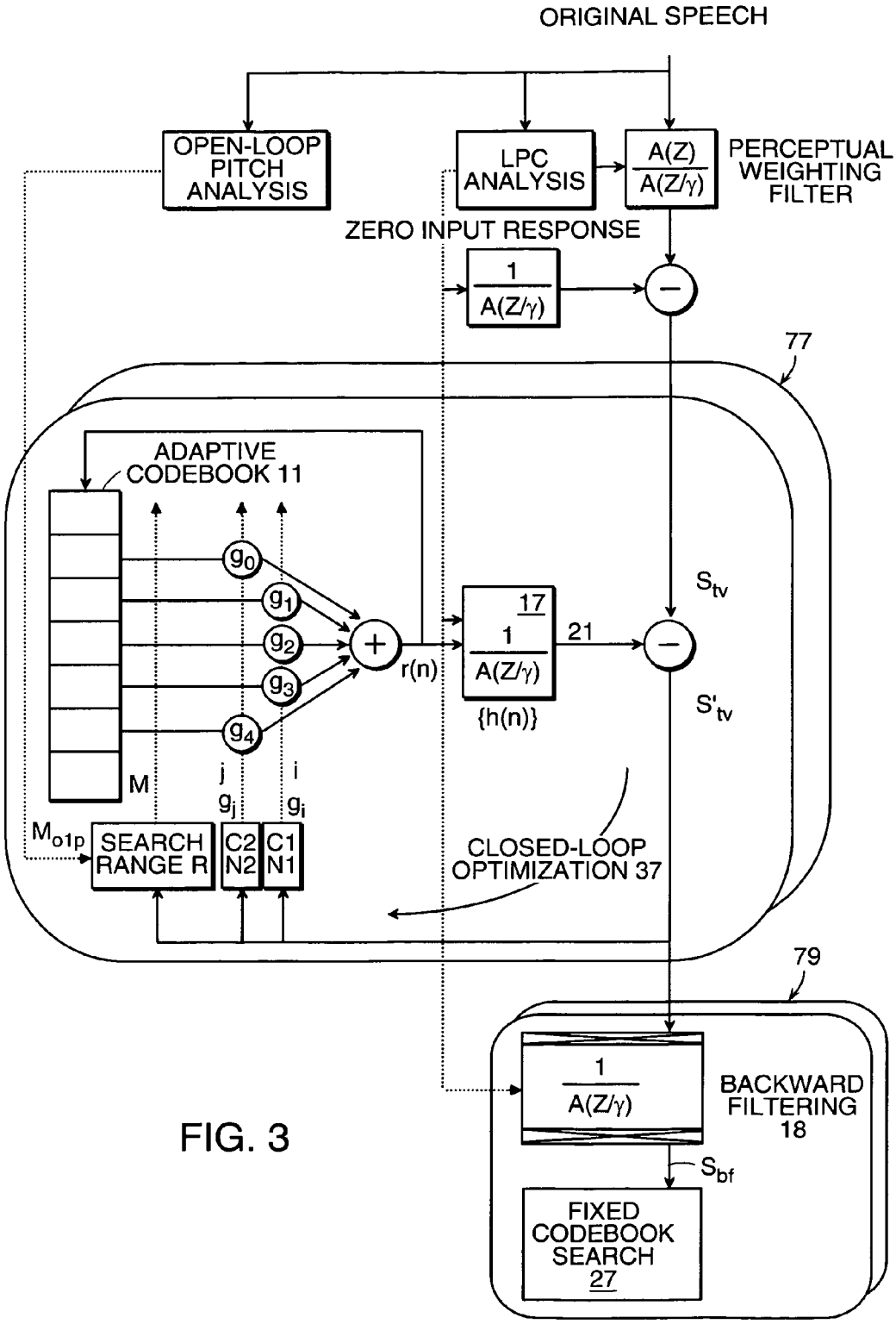
FIG. 3 is a block diagram of an LPAS speech encoder embodying the present invention.

In order to minimize the error, each of the possible combinations of the fixed codebook 61 and adaptive codebook 65 values is considered. Where, in the preferred embodiment, the fixed codebook 61 holds values in the range 0 through 1024, and the adaptive codebook 65 values range from 20 to about 146, such error minimization is a very computationally complex problem. Thus, Applicants reduce the complexity and simplify the problem by sequentially optimizing the fixed codebook 61 and adaptive codebook 65 as illustrated in FIG. 3.

In particular, Applicants minimize the error and optimize the adaptive codebook working value first, and then, treating the resulting codebook value as a constant, minimize the error and optimize the fixed codebook value. This is illustrated in FIG. 3 as two stages 77,79 of processing. In a first (upper) stage 77, there is a closed loop optimization of the adaptive codebook 11. The value output from the adaptive codebook 11 is multiplied by the weighted synthesis filter 17 and produces a first working synthesized signal 21. The error between this working synthesized signal 21 and the weighted original speech signal $S_{tv}$ is determined. The determined error is subsequently minimized via a feedback loop 37 adjusting the adaptive codebook 11 output. Once the error has been minimized and an optimum adaptive contribution is estimated, the first processing stage 77 outputs an adjusted target speech signal $S'_{tv}$.

The second processing stage 79 uses the new/adjusted target speech signal $S'_{tv}$, for estimating the optimum fixed codebook 27 contribution.

Figure 4:
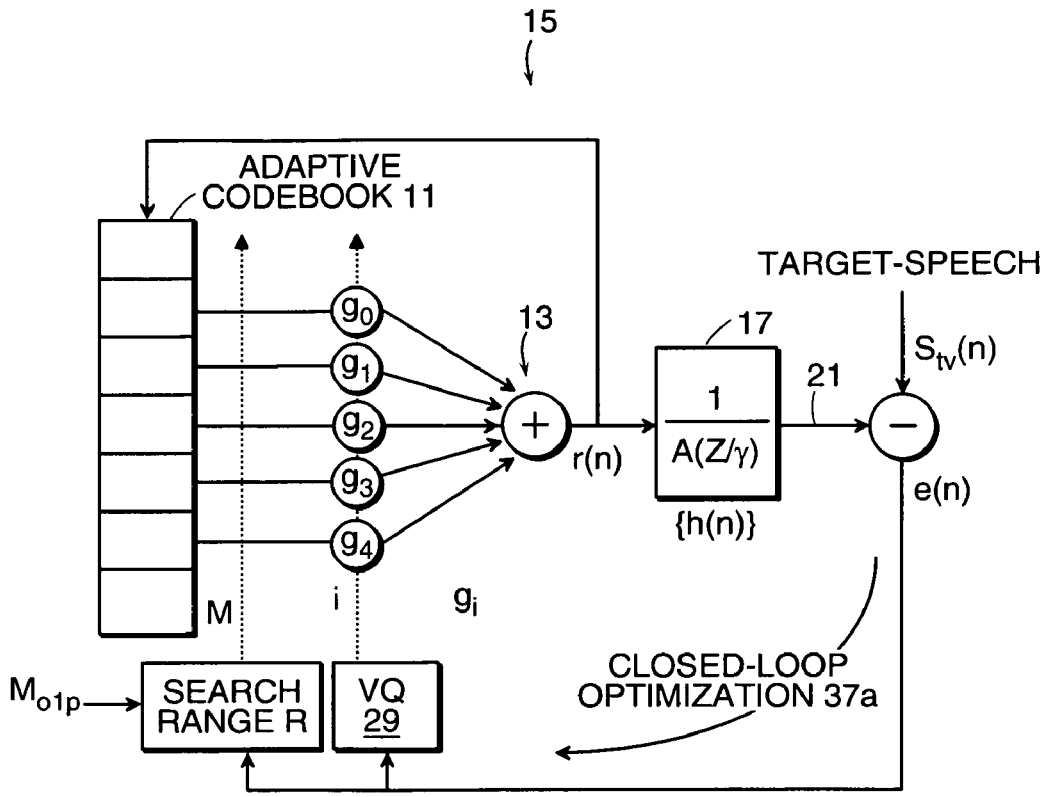
FIG. 4 is a schematic diagram of a multi-tap pitch predictor with so-called conventional vector quantization.
Figure 5:
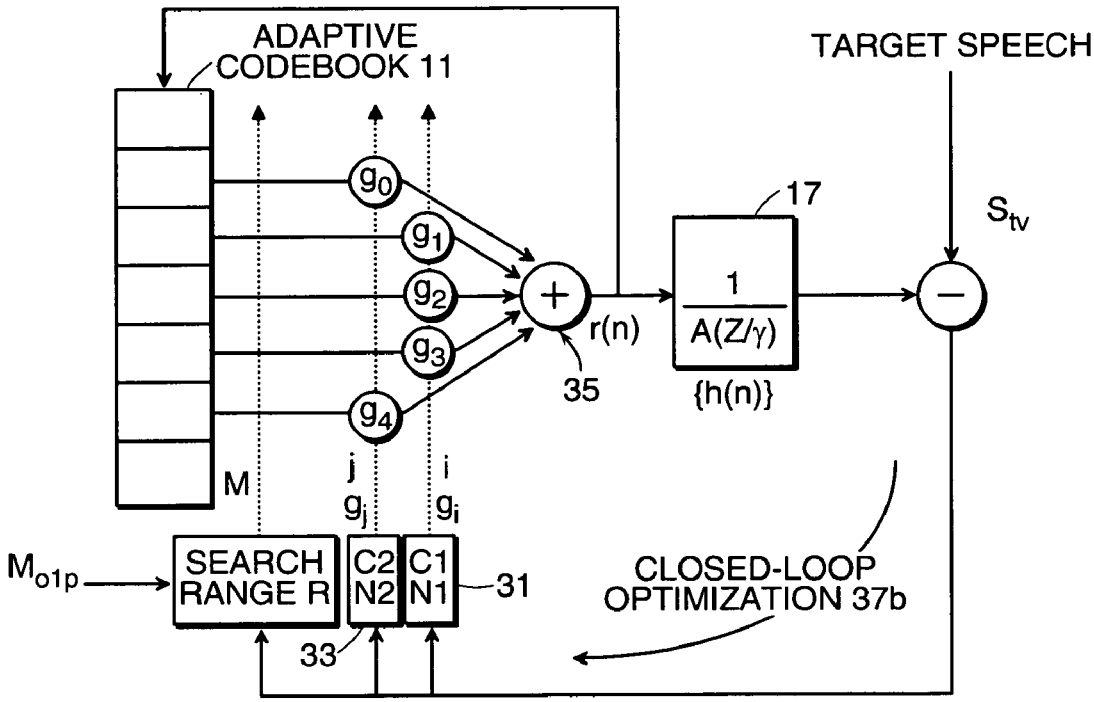
FIG. 5 is a schematic illustration of a multi-tap pitch predictor with product code vector quantized parameters of the present invention.

In the preferred embodiment, multi-tap pitch predictor coding is employed to efficiently search the adaptive codebook 11, as illustrated in FIGS. 4 and 5. In that case, the goal of processing stage 77 (FIG. 3) becomes the task of finding the optimum adaptive codebook 11 contribution.

Multi-tap Pitch Predictor (MTPP) Coding:

The general transfer function of the MTPP with delay M and predictor coefficient's $g_k$ is given as $$P(z) = 1 - \sum_{k=0}^{p-1} g_k z^{-(M-[p/2]+k)}$$

For a single-tap pitch predictor p=1. The speech quality, complexity and bit-rate are a function of p. Higher values of p result in higher complexity, bit rate, and better speech quality. Single-tap or three-tap pitch predictors are widely used in LPAS coder design. Higher-tap (p>3) pitch predictors give better performance at the cost of increased complexity and bit-rate.

The bit-rate requirement for higher-tap pitch predictors can be reduced by delta-pitch coding and vector quantizing the predictor coefficients. Although use of vector quantization adds more complexity in the pitch predictor coding, the vector quantization (VQ) of the multiple coefficients $g_k$ of the MTPP is necessary to reduce the bits required in encoding the coefficients. One such vector quantization is disclosed in D. Veeneman & B. Mazor, "Efficient Multi-Tap Pitch Predictor for Stochastic Coding," *Speech and Audio Coding for Wireless and Network Applications*, Kluwner Academic Publisher, Boston, Mass., pp. 225–229.

In addition, by integrating the VQ search process in the closed-loop optimization process 37 of FIG. 3 (as indicated by 37*a* in FIG. 4), the performance of the VQ is improved. Hence perceptually weighted mean squared error criterion is used as the distortion measure in the VQ search procedure. One example of such weighted mean square error criterion is found in J. H. Chen, "Toll-Quality 16 kbps CELP Speech Coding with Very Low Complexity," *Proceedings of the International Conference on Acoustics, Speech and Signal Processing*, pp. 9–12, 1995. Others are suitable. Moreover, for better coding efficiency, the lag M and coefficient's gk are jointly optimized. The following explains the procedure for the case of a 5-tap pitch predictor 15 as illustrated in FIG. 4. The method of FIG. 4 is referred to as "Conventional VQ".

Let r(n) be the contribution from the adaptive codebook 11 or pitch predictor 13, and let $s_{tv}(n)$ be the target vector and h(n) be the impulse response of the weighted synthesis filter 17. The error e(n) between the synthesized signal 21 and target, assuming zero contribution from a stochastic codebook 11 and 5-tap pitch predictor 13, is given as $$e(n) = s_{tv}(n) - \sum_{j=0}^{j=n} h(n-j) \sum_{k=0}^{k=4} g_k r(n-(M-2+k))$$

In matrix notation with vector length equal to subframe length, the equation becomes $$e = s_{tv} - g_0 Hr_0 - g_1 Hr_1 - g_2 Hr_2 - g_3 Hr_3 - g_4 Hr_4$$

where H is impulse response matrix of weighted synthesis filter 17. The total mean squared error is given by $$\begin{aligned} E = e^T e = {} & s_{tv}^T s_{tv} - 2g_0 s_{tv}^T Hr_0 - 2g_1 s_{tv}^T Hr_1 - 2g_2 s_{tv}^T Hr_2 - \\ & 2g^3 s_{tv}^T Hr_3 - 2g_4 S_{tv}^T Hr_4 + g_0^2 r_0^T H^T Hr_0^h + \\ & g_1^2 r_1^T H^T Hr_1^h + g_2^2 r^T H^T Hr_2^h + g_3^2 r_3^T H^T Hr_3^h \\ & + g_4^2 r_4^T H^T Hr_4^h + 2g_0 g_1 r_0^T H^T Hr_1^h + \\ & 2g_0 g_2 r_0^T H^T Hr_2^h + 2g_0 g_3 r_0^T H^T Hr_3^h \\ & + 2g_0 g_4 r_0^T H^T Hr_4^h + 2g_1 g_2 r_1^T H^T Hr_2^h + \\ & 2g_1 g_3 r_1^T H^T Hr_3^h + 2g_1 g_4 r_1^T h^T Hr_4^h \\ & + 2g_2 g_3 r_2^T H^T Hr_3 h + 2g_2 g_4 r_2^T H^T Hr_4^h + \\ & 2g_3 g_4 r_3^T H^T Hr_4^h \end{aligned}$$

$$\begin{aligned} \text{Let } g = [ & g_0, g_1, g_2, g_3, g_4, -0.5g_0^2, -0.5\, g_1^2, -0.5g_2^2, \\ & -0.5g_3^2, 0.5g_4^2, -g_0 g_1, -g_0 g_2, -g_0 g_3, -g_0 g_4, \\ & -g_1 g_2, -g_1 g_3, -g_1 g_4, -g_2 g_3, -g_2 g_4, -g_3 g_4] \end{aligned}$$

$$\begin{aligned} \text{Let } c_M = [ & s_{tv}^T \mathrm{Hr}_0, s_{tv}^T \mathrm{Hr}_1, s_{tv}^T Hr_2, s_{tv}^T Hr_3, s_{tv}^T Hr_4, \\ & r_0^T H^T Hr_0^h, r_1^T H^T Hr_1^h, r_2^T H^T Hr_2^h, r_3^T H^T Hr_3^h, \\ & r_4^T H^T Hr_4^h, r_0^T H^T Hr_1^h, r_0^T H^T Hr_2^h, r_0^T H^T Hr_3^h, \\ & r_0^T H^T Hr_4^h, r_1^T H^T Hr_2^h, r_1^T H^T Hr_3^h, r_1^T H^T Hr_4^h, \\ & r_2^T H^T Hr_3^h, r_2^T H^T Hr_4^h, r_3^T H^T Hr_4^h] \end{aligned}$$

$$E = e^T e = s_{tv}^T s_{tv} - 2c_M^T g$$

The g vector may come from a stored codebook 29 of size N and dimension 20 (in the case of a 5-tap predictor). For each entry (vector record) of the codebook 29, the first five elements of the codebook entry (record) correspond to five predictor coefficients and the remaining 15 elements are stored accordingly based on the first five elements, to expedite the search procedure. The dimension of the g vector is T+(T*(T−1)/2), where T is the number of taps. Hence the search for the best vector from the codebook 29 may be described by the following equation as a function of M and index i.

$$E(M,i) = e^T e = s_{tv}^T s_{tv} - 2c_M^T g_i$$

where $M_{olp} - 1 \leqq M \leqq M_{olp} - 2$, and i=0 . . . N.

Minimizing E(M,i) is equivalent to maximizing $c_M^T g_i$, the inner product of two 20 dimensional vectors. The best combination (M,i) which maximize $c_M^T g_i$ is the optimum index and pitch value. Mathematically, $_{(M,i)} \max\{c_M^T g_i\}$ where $M_{olp} - 1 \leqq M \leqq M_{olp} - 2$, and i=0 . . . N.

For an 8-bit VQ, the complexity reduction is a trade-off between computational complexity and memory (storage) requirement. See the inner 2 columns in Table 2. Both sets of numbers in the first three rows/VQ methods are high for LPAS coders in low cost applications such as digital answering machines.

Figure 1:
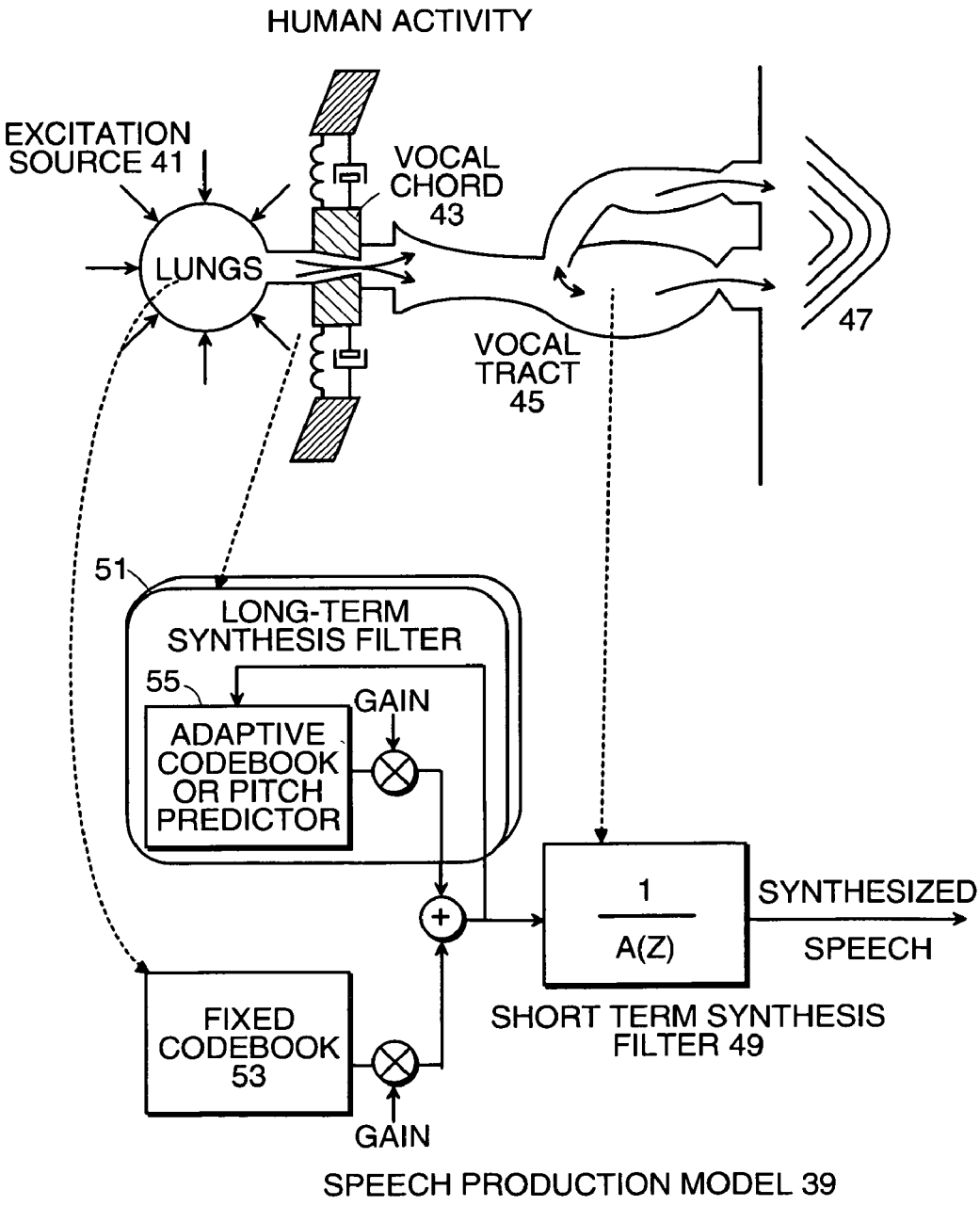
FIG. 1 is a schematic illustration of the speech production model on which LPAS coders are based.

The storage space problem is solved by Product Code VQ (PCVQ) design of S. Wang, E. Paksoy and A. Gersho, "Product Code Vector Quantization of LPC Parameters," *Speech and Audio Coding for Wireless and Network Applications*, Kluwner Academic Publisher, Boston, Mass. A copy of this reference is attached and incorporated herein by reference for purposes of disclosing the overall product code vector quantization (PCVQ) technique. Wang et al used the PCVQ technique to quantize the Linear Predictive Coding (LPC) parameters of the short term synthesis filter in LPAS coders. Applicants in the present invention apply the PCVQ technique to quantize the pitch predictor (adaptive codebook) 55 parameters in the long term synthesis filter 51 (FIG. 1) in LPAS coders. Briefly, the g vector is divided into two subvectors g1 and g2. The elements of g1 and g2 come from two separate codebooks C1 and C2. Each possible combination of g1 and g2 to make g is searched in analysis-by-synthesis fashion, for optimum performance. FIG. 5 is a graphical illustration of this method.

In particular, codebooks C1 and C2 are depicted at 31 and 33, respectively in FIG. 5. Codebook C1 (at 31) provides subvector $g_i$ while codebook C2 (at 33) provides subvector $g_j$. Further, codebook C2 (at 33) contains elements corresponding to g0 and g4, while codebook C1 (at 31) contains elements corresponding to g1, g2 and g3. Each possible combination of subvectors $g_j$ and $g_i$ to make a combined g vector for the pitch predictor 35 is considered (searched) for optimum performance. The VQ search process is integrated in the closed loop optimization 37 (FIG. 3) as indicated by 37*b* in FIG. 5. As such, lag M and coefficients $g_i$ and $g_j$ are jointly optimized. Preferably, a perceptually weighted mean square error criterion is used as the distortion measure in the VQ search procedure. Hence the best combination of subvectors $g_i$ and $g_j$ from codebooks C1 and C2 may be described as a function of M and indices i,j as the best combination of (M,i,j) which maximizes $C_M^T g_{ij}$ (the optimum indices and pitch values as further discussed below).

Specifically, $g_{ij} = g1_i + g2_j + g12_{ij}$ $$\max\{C_M^T g_{ij}\}(M,ij)$$

where $M_{olp} - 1 \leqq M \leqq M_{olp} - 2$, i=0 . . . N1, and j=0 . . . N2. T is the number of taps. N=N1*N2. N1 and N2 are, respectively, the size of codebooks C1 and C2.

Where C1 contains elements corresponding to g1, g2, g3, then $g1_i$ is a 9-dimensional vector as follows.

$$\begin{aligned} g1_i = [ & 0, g_{1i}, g_{2i}, g_{3i}, 0, 0, -0.5g_{1i}^2, 0.5g_{2i}^2, -0.5g_{3i}^2, 0, 0, 0, \\ & 0, 0, -g_{1i}g_{2i}, -g_{1i}g_{3i}, 0, -g_{2i}g_{3i}, 0, 0] \end{aligned}$$

Let the size of C1 codebook be N1=32. The storage requirement for codebook C1 is S1=9*32=288 words.

Where C2 contains elements corresponding to g0,g4, then g2$j$ is a 5 dimensional vector as shown in the following equation.

$$g2_j=[g_{0j}0,0,0,\ g_{4j},-0.5g_{0j}^2,0,0,0,-0.5g_{4j}^2 0,0,0,-g_{0j}g_{4j},\ 0,0,0,0,0,0]$$

Let the size of C2 codebook be N2=8. The storage requirement for codebook C2 is S2=5*8=40 words.

Thus, the total storage space for both of the codebooks=288+40=328 words. This method also requires 6*4*256=6144 multiplications for generating the rest of the elements of g12$_{ij}$ which are not stored, where $$g12_{ij}=[0,0,0,0,0,0,0,0,0,0,\ -g_{0j}g_{1i},-g_{0j}g_{2i},-g_{0j}g_{3i},0,0,\ 0,-g_{1i}g_{4j},0,-g_{3i}g_{4j}]$$

Hence a savings of about 4800 words is obtained by computing 6144 multiplication's per subframe (as compared to the Fast D-dimension VQ method in Table 2). The performance of PCVQ is improved by designing the multiple C2 codebook based on the vector space of the C1 codebook. A slight increase in storage space and complexity is required with that improvement. The overall method is referred to in the Tables as "Full Search PCVQ".

Applicants have discovered that further savings in computational complexity and storage requirement is achieved by sequentially selecting the indices of C1 and C2, such that the search is performed in two stages. For further details see J. Patel, "Low Complexity VQ for Multi-tap Pitch Predictor Coding," in *IEEE Proceedings of the International Conference on Acoustics, Speech and Signal Processing*, pp. 763–766, 1997, herein incorporated by reference (copy attached).

Specifically,

Stage 1: For all candidates of M, the best index i=I[M] from codebook C1 is determined using the perceptually weighted mean square error distortion criterion previously mentioned.

For $M_{olp}-1 \leqq M \leqq M_{olp}-2$ $$\underset{i}{I[M]} = \max\{c_M^T g\, I_i\} \qquad i = 0 \ldots N1$$

Stage 2: The best combination M, I[M] and index j from codebook C2 is selected using the same distortion criterion as in Stage 1 above.

$$g_{I[M]j}=g1_{I[M]}=g2_j=g12_{I[M]j}$$

$$\max\ \{c_M^T g_I[M]_j\}(M,I[M]j)$$

where $M_{olp}-1 \leqq M \leqq M_{olp}-2$, and j=0 . . . N2.

This (the invention) method is referred to as "Sequential PCVQ". In this method $c_M^T g$ is evaluated (32*4)+(8*4)=160 times while in "Full Search PCVQ", $c_M^T g$ is evaluated 1024 times. This savings in scalar product ($c_M^T g$) computations may be utilized in computing the last 15 elements of g when required. The storage requirement for this invention method is only 112 words.

Comparisons:

A comparison is made among all the different vector quantization techniques described above. The total multiplication and storage space are used in the comparison.

Let T=Taps of pitch predictor=T1+T2,
D=Length of g vector=T+$T_x$,
$T_x$=Length of extra vector=T(T+1)/2
N=size of g vector VQ,
D1=Length of g1 vector=T1+T1$_x$,
T1$_x$=T1(T1+1)/2,
N1=size of g1 vector VQ,
D2=Length of g2 vector=T2+T2$_x$,
T2$_x$=T2(T2+1)/2,
N2=size of g2 vector VQ,
D12=size of g12 vector=$T_x$−T1$_x$−T2$_x$,
R=Pitch search range,
N=N1*N2.

TABLE 1

Complexity of MTPP

| VQ Method | Total Multiplication | Storage Requirement |
|---|---|---|
| Fast D-dimension conventional VQ | N*R*D | N*D |
| Low Memory D-dimension conventional VQ | N*R*(D + $T_x$) | N*T |
| Full Search Product Code VQ | N*R*(D + D12) | (N1*D1) + (N2*D2) |
| Sequential Search Product Code VQ | N1*R*(D1 + T1$_X$) + N2*R*(D2 + T2$_x$) | (N1*T1) + (N2*T2) |

For the 5-tap pitch predictor case,
T=5,N=256, T1=3, T2=2,N1=32,N2=8,R=4,
D=20, D1=9, D2=5, D12=6, $T_x$=15, T1$_x$=6, T2$_x$=3.

All four of the methods were used in a CELP coder. The rightmost column of Table 2 shows the segmental signal-to-noise ratio (SNR) comparison of speech produced by each VQ method.

TABLE 2

5-Tap Pitch Predictor Complexity and Performance

| VQ Method | Total Multiplication | Storage Space in Words | Seg. SNR dB |
|---|---|---|---|
| Fast D-dimension VQ | 20480 | 5120 | 6.83 |
| Low Memory D-dimension VQ | 20480 + 15360 | 1280 | 6.83 |
| Full Search Product Code VQ | 20480 + 6144 | 288 + 40 | 6.72 |
| Sequential Search Product Code VQ | 1920 + 256 + 6144 | 96 + 16 | 6.59 |

Figure 6:
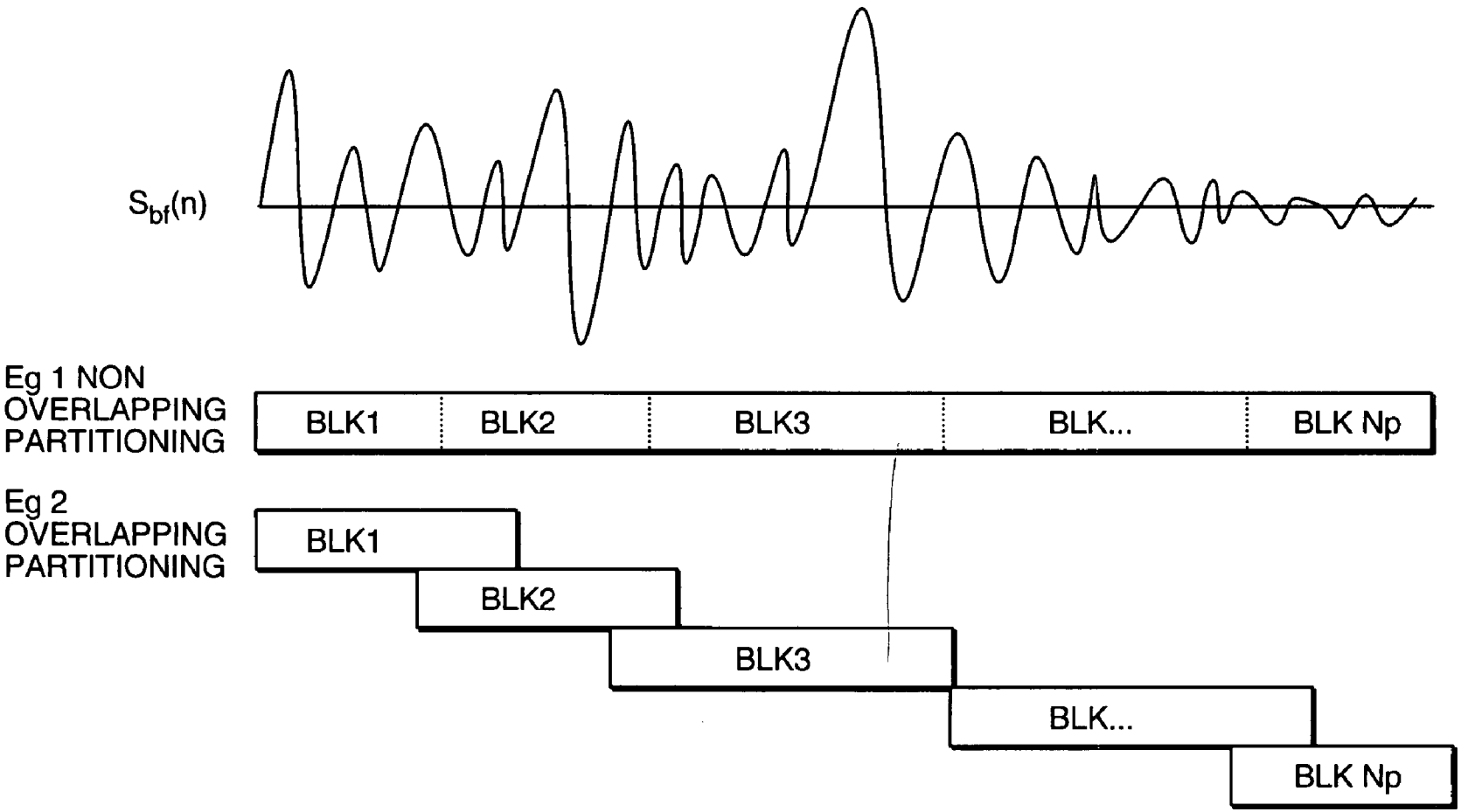
FIGS. 6 and 7 are schematic diagrams illustrating fixed codebook vectors of the present invention, formed of blocks corresponding to pulses of the target speech signal.
Figure 7:
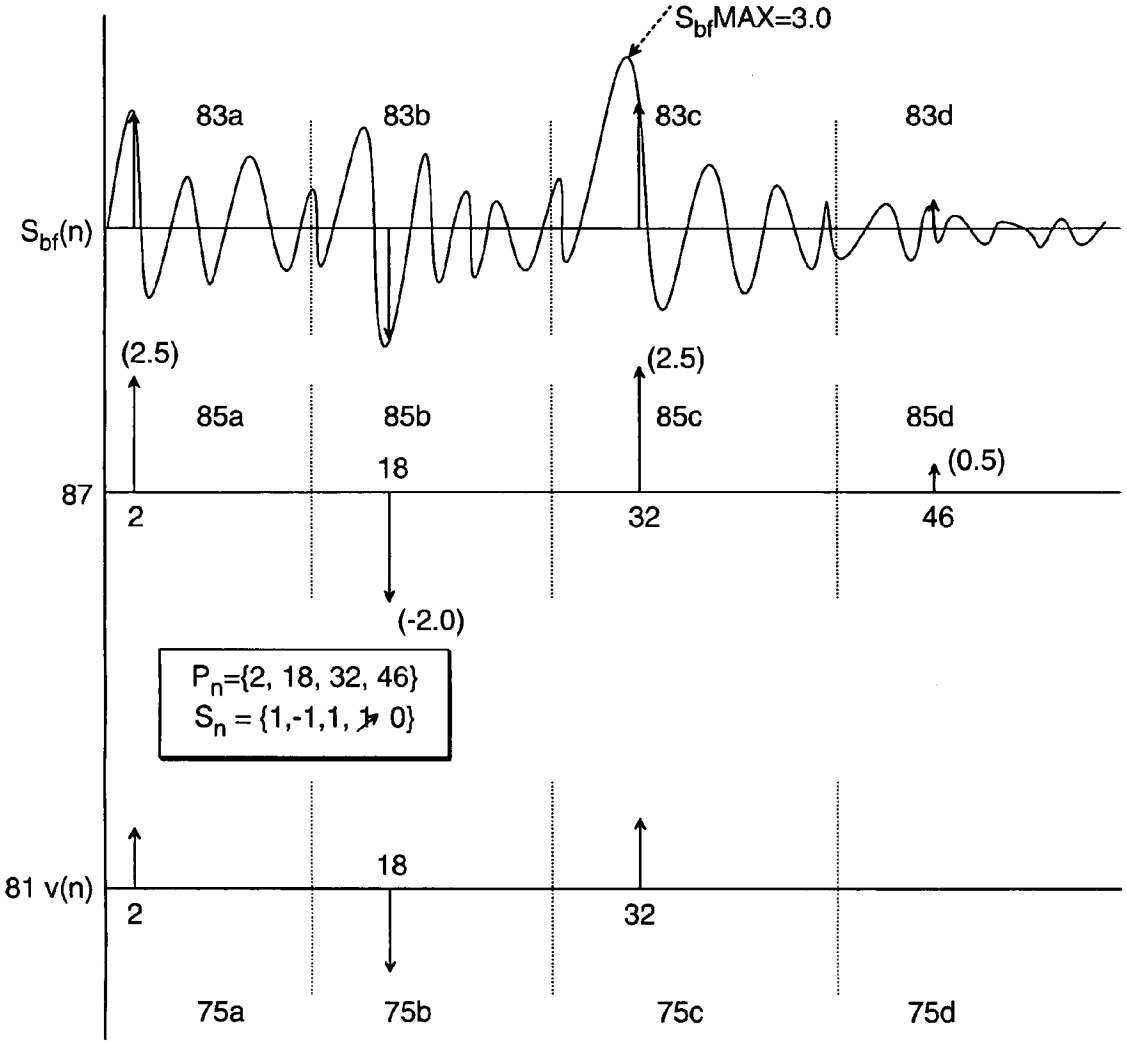

Referring back to FIG. 3, after optimizing the adaptive codebook 11 search according to the foregoing VQ techniques illustrated in FIG. 5, first processing stage 77 is completed and the second processing stage 79 follows. In the second processing stage 79, the fixed codebook 27 search is performed. Search time and complexity is dependent on the design of the fixed codebook 27. To process each value in the fixed codebook 27 would be costly in time and computational complexity. Thus the present invention provides a fixed codebook that holds or stores ternary vectors (−1,0,1) i.e., vectors formed of the possible permutations of 1,0,−1, as illustrated in FIGS. 6 and 7 and discussed next.

In the preferred embodiment, for each subframe, target speech signal $S'_{tv}$ is backward filtered 18 through the synthesis filter (FIG. 3) to produce working speech signal $S_{bf}$ as follows.

$$S_{bf}(j) = \sum_{n=j}^{n=NSF-1} S'_{tv}(n)\,h(n-j) \qquad 0 \le j \le NSF-1$$

where, NSF is the sub-frame size and $$h(n) = \frac{1}{A(z/\gamma)}.$$

Next, the working speech signal $S_{bf}$ is partitioned into $N_p$ blocks Blk1, Blk2 . . . Blk $N_p$ (overlapping or non-overlapping, see FIG. 6). The best fixed codebook contribution (excitation vector v) is derived from the working speech signal $S_{bf}$. Each corresponding block in the excitation vector v(n) has a single or no pulse. The position $P_n$ and sign $S_n$ of the peak sample (i.e., corresponding pulse) for each block Blk1, . . . Blk $N_p$ is determined. Sign is indicated using +1 for positive, −1 for negative, and 0.

Further, let $S_{bf}$max be the maximum absolute sample in working speech signal $S_{bf}$. Each pulse is tested for validity by comparing the pulse to the maximum pulse magnitude (absolute value thereof) in the working speech signal $S_{bf}$. In the preferred embodiment, if the signed pulse of a subject block is less than about half the maximum pulse magnitude, then there is no valid pulse for that block. Thus, sign $S_n$ for that block is assigned the value 0.

```
That is,
For n = 1 to Np
        If Sbf(Pn)*Sn < μ*Sbfmax
                Sn = 0
    EndIf
EndFor
```

The typical range for μ is 0.4–0.6.

The foregoing pulse positions $P_n$ and signs $S_n$ of the corresponding pulses for the blocks Blk (FIG. 6) of a fixed codebook vector, form position vector $P_n$ and sign vector $S_n$ respectively. In the preferred embodiment, only certain positions in working speech signal $S_{bf}$ are considered, in order to find a peak/subject pulse in each block Blk. It is the sign vector $S_n$ with elements adjusted to reflect validity of pulses of the blocks Blk of a codebook vector which ultimately defines the codebook vector for the present invention optimized fixed codebook 27 (FIG. 3) contribution.

In the example illustrated in FIG. 7, the working speech signal (or subframe vector) $S_{bf}$(n) is partitioned into four non-overlapping blocks 83*a*, 83*b*, 83*c* and 83*d*. Blocks 75*a*, 75*b*, 75*c*, 75*d* of a codebook vector 81 correspond to blocks 83*a*, 83*b*, 83*c*, 83*d* of working speech signal $S_{bf}$ (i.e., backward filtered target signal $S'_{tv}$). The pulse or sample peak of block 83*a* is at position 2, for example, where only positions 0, 2, 4, 6, 8, 10 and 12 are considered. Thus, $P_1$=2 for the first block 75*a*. Corresponding sign of the subject pulse is positive; so $S_1$=1. Block 83*b* has a sample peak (corresponding negative pulse) at say for example position 18, where positions 14, 16, 18, 20, 22, 24 and 26 are considered. So the corresponding block 75*b* (the second block of codebook vector 81) has $P_2$=18 and sign $S_2$=−1. Likewise, block 83*c* (correlated to third codebook vector block 75*c*) has a sample positive peak/pulse at position 32, for example, where only every other position is considered in that block 83*c*. Thus, $P_{3=32}$ and $S_3$=1. It is noted that this block 83*c* also contains $S_{bf}$max, the working speech signal pulse with maximum magnitude, i.e., absolute value, but at a position not considered for purposes of setting $P_n$.

Lastly, block 83*d* and corresponding block 75*d* have a sample positive peak/pulse at position 46 for example. In that block 83*d*, only even positions between 42 and 52 are considered. As such, $P_4$=46 and $S_4$=1.

The foregoing sample peaks (including position and sign) are further illustrated in the graph line 87, just below the waveform illustration of working speech signal $S_{bf}$ in FIG. 7. In that graph line 87, a single vertical scaled arrow indication per block 83,75 is illustrated. That is, for corresponding block 83*a* and block 75*a*, there is a positive vertical arrow 85*a* close to maximum height (e.g., 2.5) at the position labeled 2. The height or length of the arrow is indicative of magnitude (=2.5) of the corresponding pulse/sample peak.

For block 83*b* and corresponding block 75*b*, there is a graphical negative directed arrow 85*b* at position 18. The magnitude (i.e., length=2) of the arrow 85*b* is similar to that of arrow 85*a* but is in the negative (downward) direction as dictated by the subject block 83*b* pulse.

For block 83*c* and corresponding block 75*c*, there is graphically shown along graph line 87 an arrow 85*c* at position 32. The length (=2.5) of the arrow is a function of the magnitude (=2.5) of the corresponding sample peak/pulse. The positive (upward) direction of arrow 85*c* is indicative of the corresponding positive sample peak/pulse.

Lastly, there is illustrated a short (length=0.5) positive (upward) directed arrow 85*d* at position 46. This arrow 85*d* corresponds to and is indicative of the sample peak (pulse) of block 83*d*/codebook vector block 75*d*.

Each of the noted positions are further shown to be the elements of position vector $P_n$ below graph line 87 in FIG. 7. That is, $P_n$={2,18,32,46}. Similarly, sign vector $S_n$ is initially formed of (i) a first element (=1) indicative of the positive direction of arrow 85*a* (and hence corresponding pulse in block 83*a*), (ii) a second element (=−1) indicative of the negative direction of arrow 85*b* (and hence corresponding pulse in block 83*b*), (iii) a third element (=1) indicative of the positive direction of arrow 85*c* (and hence corresponding pulse of block 83*c*), and (iv) a fourth element (=1) indicative of the positive direction of arrow 85*d* (and hence corresponding pulse of block 83*d*). However, upon validating each pulse, the fourth element of sign vector $S_n$ becomes 0 as follows.

Applying the above detailed validity routine/procedure obtains:

$S_{bf}(P_1)*S_1=S_{bf}$(position 2)*(+1)=2.5 which is >μ$S_{bf}$max;

$S_{bf}(P_2)*S_2=S_{bf}$(position 18)*(−1)=−2*(−1)=2 which is >μ$S_{bf}$max;

$S_{bf}(P_3)*S_3=S_{bf}$(position 32)*(+1)=2.5 which is >μ$S_{bf}$max; and $S_{bf}(P_4)*S_4=S_{bf}$(position 46)*(+1)=0.5 which is <μ$S_{bf}$max, where 0.4≦μ≦0.6 and $S_{bf}$max=/$S_{bf}$(position 31)/=3. Thus the last comparison, i.e., $S_4$ compared to $S_{bf}$max, determines $S_4$ to be an invalid pulse where 0.5<μ$S_{bf}$max. So $S_4$ is assigned a zero value in sign vector $S_n$, resulting in the $S_n$ vector illustrated near the bottom of FIG. 7.

The fixed codebook contribution or vector 81 (referred to as the excitation vector v(n)) is then constructed as follows:

```
For n = 0 to NSF−1
    If n = =P_n
        v(n) = S_n
    EndIf
EndFor
```

Thus, in the example of FIG. 7, codebook vector 81, i.e., excitation vector v(n), has three non-zero elements. Namely, v(2)=1; v(18)=−1; v(32)=1, as illustrated in the bottom graph line of FIG. 7.

The consideration of only certain block 83 positions to determine sample peak and hence pulse per given block 75, and ultimately excitation vector 81 v(n) values, decreases complexity with substantially minimal loss in speech quality. As such, second processing phase 79 is optimized as desired.

EXAMPLE

The following example uses the above described fast, fixed codebook search for creating and searching a 16-bit codebook with subframe size of 56 samples. The excitation vector consists of four blocks. In each block, a pulse can take any of seven possible positions. Therefore, 3 bits are required to encode pulse positions. The sign of each pulse is encoded with 1 bit. The eighth index in the pulse position is utilized to indicate the existence of a pulse in the block. A total of 16 bits are thus required to encode four pulses (i.e., the pulses of the four excitation vector blocks).

By using the above described procedure, the pulse position and signs of the pulses in the subject blocks are obtained as follows. Table 3 further summarizes and illustrates the example 16-bit excitation codebook.

$$p1 = \max_j \{\mathrm{abs}(s_{bf}(j))\} \qquad j = 0, 2, 4, 6, 8, 10, 12$$

$$v(p1) = s_{bf}(p1)$$

$$p2 = \max_j \{\mathrm{abs}(s_{bf}(j))\} \qquad j = 14, 16, 18, 20, 22, 24, 26$$

$$v(p2) = s_{bf}(p2)$$

$$p3 = \max_j \{\mathrm{abs}(s_{bf}(j))\} \qquad j = 28, 30, 32, 34, 36, 38, 40$$

$$v(p3) = s_{bf}(p3)$$

$$p4 = \max_j \{\mathrm{abs}(s_{bf}(j))\} \qquad j = 42, 44, 46, 48, 50, 52, 54$$

$$v(p4) = s_{bf}(p4)$$

where abs(s) is the absolute value of the pulse magnitude of a block sample in $S_{bf}$.

```
MaxAbs = max(abs(v(i)))
        where i = p1, p2, p3, p4; and
v(i) = 0      if v(i) <0.5 *MaxAbs, or
    sign (v(i))   otherwise
        for i = p1, p2, p3, p4.
```

Let v(n) be the pulse excitation and $v_h(n)$ be the filtered excitation (FIG. 3), then prediction gain G is calculated as

TABLE 3

16-bit fixed excitation codebook $$G = \frac{\sum_{n=0}^{n=NSF-1} S'_{tv}(n)v_h(n)}{\sum_{n=0}^{n=NSF-1} V_h(n)v_h(n)}$$

| Block | Pulse Position | Bits Sign | Bits Position |
|---|---|---|---|
| 1 | 0, 2, 4, 6, 8, 10, 12 | 1 | 3 |
| 2 | 14, 16, 18, 20, 22, 24, 26 | 1 | 3 |
| 3 | 28, 30, 32, 34, 36, 38, 40 | 1 | 3 |
| 4 | 42, 44, 46, 48, 50, 52, 54 | 1 | 3 |

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

For example, the foregoing describes the application of Product Code Vector Quantization to the pitch predictor parameters. It is understood that other similar vector quantization may be applied to the pitch predictor parameters and achieve similar savings in computational complexity and/or memory storage space.

Further a 5-tap pitch predictor is employed in the preferred embodiment. However, other multi-tap (>2) pitch predictors may similarly benefit from the vector quantization disclosed above. Additionally, any number of working codebooks 31,33 (FIG. 5) for providing subvectors $g_i$, $g_j$ . . . may be utilized in light of the discussion of FIG. 5. The above discussion of two codebooks 31,33 is for purposes of illustration and not limitation of the present invention.

In the foregoing discussion of FIG. 7, every even numbered position was considered for purposes of defining pulse positions $P_n$ in corresponding blocks 83. Every third or every odd position or a combination of different positions for different blocks 83 and/or different subframes $S_{bf}$ and the like may similarly be utilized. Reduction of complexity and bit rate is a function of reduction in number of positions considered. There is a tradeoff however with final quality. Thus, Applicants have disclosed consideration of every other position to achieve both low complexity and high quality at a desired bit-rate. Other combinations of reduced number of positions considered for low complexity but without degradation of quality are now in the purview of one skilled in the art.

Likewise, the second processing phase 79 (optimization of the fixed codebook search 27, FIG. 3) may be employed singularly (without the vector quantization of the pitch predictor parameters in the first processing phase 77), as well as in combination as described above.

What is claimed is:

1. In a system having working memory and a digital processor, a method for producing a fixed codebook for a speech signal encoder, comprising:

filtering a target speech signal; and forming entries in the fixed codebook of derived vector values indicating pulses in the filtered target speech signal.

2. The method as claimed in claim 1 further including partitioning the filtered target speech signal into blocks.

3. The method as claimed in claim 2 wherein the blocks are non-overlapping.

4. The method as claimed in claim 2 wherein the blocks are overlapping.

5. The method as claimed in claim 1 wherein the filtering is backward filtering.

6. The method as claimed in claim 1 wherein the vector values are ternary vector values (1, 0, −1).

7. The method as claimed in claim 1 wherein the vector values substantially indicate peak pulse positions in subvectors of the filtered target speech signal.

8. The method as claimed in claim 1 further including considering non-contiguous positions in the filtered target speech signal to determine substantially peak pulse positions in the filtered target speech signal.

9. The method as claimed in claim 1 wherein the derived vector values include sign and position information represented in bits.

10. The method as claimed in claim 9 wherein the number of bits of the derived vector values includes a sign bit plus the number of bits representing, in binary, the number of locations within a subvector at which a peak pulse position is considered.

11. In a system having working memory and a digital processor, a fixed codebook for a speech signal encoder, comprising:

a filter filtering a target speech signal; and entries in the fixed codebook of derived vector values indicating pulses in the filtered target speech signal.

12. The fixed codebook as claimed in claim 11 wherein the filtered target speech signal is partitioned into blocks.

13. The fixed codebook as claimed in claim 12 wherein the blocks are non-overlapping.

14. The fixed codebook as claimed in claim 12 wherein the blocks are overlapping.

15. The fixed codebook as claimed in claim 11 wherein the filter is a backward filter.

16. The fixed codebook as claimed in claim 11 wherein the vector values are ternary vector values (1, 0, −1).

17. The fixed codebook as claimed in claim 11 wherein the vector values substantially indicate peak pulse positions in subvectors of the filtered target speech signal.

18. The fixed codebook as claimed in claim 11 in which non-contiguous positions in the filtered target speech signal are considered to determine substantially peak pulse positions in the filtered target speech signal.

19. The fixed codebook as claimed in claim 11 wherein the derived vector values include sign and position information represented in bits.

20. The fixed codebook as claimed in claim 19 wherein the number of bits of the derived vector values includes a sign bit plus the number of bits representing, in binary, the number of locations within a subvector at which a peak pulse position is considered.

21. A system for producing a fixed codebook for a speech signal encoder, the system comprising:

an electronic device having a working memory and a digital processor; and a fixed codebook executable in the working memory by the digital processor, the fixed codebook including:

a filter filtering a target speech signal; and entries in the fixed codebook of derived vector values indicating pulses in the filtered target speech signal.

22. In a system having working memory and a digital processor, an apparatus for producing a fixed codebook for a speech signal encoder, comprising:

means for filtering a target speech signal; and means for forming entries in the fixed codebook of derived vector values indicating pulses in the filtered target speech signal.

* * * * *